United States Patent [19]

Hui

[11] Patent Number: 4,695,266

[45] Date of Patent: Sep. 22, 1987

[54] STEERABLE ELECTRIC TOY CAR

[76] Inventor: Hsu W. Hui, No. 160, Wu Fu I Road, Kaohsiung City, Taiwan

[21] Appl. No.: 908,235

[22] Filed: Sep. 17, 1986

[51] Int. Cl.[4] ..... A63H 33/00

[52] U.S. Cl. ..... 446/454; 446/460

[58] Field of Search ..... 446/454, 460, 468, 230

[56] References Cited

U.S. PATENT DOCUMENTS

| | | | |
|---|---|---|---|
| 3,101,569 | 8/1963 | Giardina | 446/454 X |
| 4,471,566 | 9/1984 | Ishimoto | 446/460 X |
| 4,508,516 | 4/1985 | D'Andrade et al. | 446/454 X |

FOREIGN PATENT DOCUMENTS

| | | | |
|---|---|---|---|
| 1462860 | 1/1977 | United Kingdom | 446/454 |

*Primary Examiner*—Kenneth Downey

*Attorney, Agent, or Firm*—Cushman, Darby & Cushman

[57] ABSTRACT

A steerable electric toy car includes a steering mechanism including a weight body with an electrically conductive activating finger and a weight at two ends thereof, suspended on a grip member. Two pairs of contacts are fixed on the grip member in a position that the activating finger does not abut them when the grip member is held upright, but that the activating finger does abut them when the grip member is rotated and the weight maintains the original position of the weight body relative to the ground. The toy car further includes a gearing for turning the wheels of the car which has a frictional arrangement for preventing damage to the powering motor when the wheels can be turned no further.

8 Claims, 6 Drawing Figures

STEERABLE ELECTRIC TOY CAR

This invention relates to a toy car, particularly to an electrically-powered toy car with a remote control steering device which allows a user to steer the toy car in a manner similar to steering a real car, which is simple in construction and inexpensive to manufacture. Prior art toy cars are basically of three types. The first is the basic toy car, which is a rolling toy with wheels fixed to rotatable axles or rotatable wheels sleeved on fixed axles. Energy to propel the car is provided by the thrust of the user's arm. Such a toy is limited in the distance it can travel and the direction in which it rolls can not be controlled accurately.

The second type of prior toy car is an improvement on the first, with a spring means designed to absorb and save a certain amount of driving force and release it to power the wheels to rotate. This type is also has a limited travelling distance and ability to be steered.

The third type of prior toy car appeals to young and old enthusiasts alike. It is powered electrically and controlled via a remote control means attached by a cord to the toy. Most remote control means are in the form of a box with various control buttons to control direction, etc.

It is believed that the appeal of a toy car would be greatly increased if the toy car could be steered in a manner similar to steering a real car. It is also desirable that such a toy car be of as simple a construction as possible so as to be inexpensive to manufacture.

SUMMARY OF THE INVENTION

The primary object of this invention is to provide a steerable electric toy car of simple and inexpensive construction with the appealing feature that the toy car can be steered in a manner similar to steering a real car. Another object of this invention is to provide a steerable electric toy car with a novel steering mechanism which operates by means of a simple weight and electric contact arrangement.

A further object of this invention is to provide a steerable electric toy car with a wheel-turning mechanism that prevents damage to the motor powering the mechanism and which further includes a direction signalling arrangement to heighten the appeal of the toy car.

These and other objects are achieved by provision of a steerable electric toy car which comprises:

A toy body, including a frame; a rear shaft rotatably mounted transversely on an underside of a rear portion of the frame; a pair of first wheels fixedly mounted at opposite ends of the rear shaft, adapted to be driven by a rear motor forwards and backwards; a front shaft, rotatably mounted transversely on the underside of a front portion of the frame; a pair of second wheels fixedly mounted respectively at opposite ends of the front shaft; and means for controlling the front shaft to move with respect to a longitudinal axis of the frame. The controlling means includes a jointed control plate attached to the front shaft; a control rod engaged with and extending vertically with respect to the jointed plate; a gear mechanism including an output end coupled to the control rod, and a rear motor having an output shaft coupled with an input end of the gear mechanism so that rotation from the output shaft can be transmitted to drive the control rod. The invention also includes a control mechanism, including a grip member, adapted to be controlled by a player; contact means disposed on the grip member and electrically connected to the front motor of the toy body; and a weight body, pivotedly suspended by one end thereof on the grip member, with a weight disposed at another end of the weight body, and an activating finger disposed on the weight body near the pivoted end of the weight body in such a position that when the grip member is rotated, and the weight causes the weight body by gravity to remain vertically oriented to the ground, thereby the change of relative position of the weight body relative to said grip member will cause the activating finger to contact the contact means to close a circuit for driving the front motor.

In one aspect of the invention, the gear mechanism includes a gear box; a first shaft fixed in the gear box; a first gear rotatably mounted on the first shaft and coupled to the output shaft so as to be driven by said front motor; a restricting member fixed on the first shaft with a restricting edge, and a rotating plate rotatably mounted on the first shaft. The rotating plate includes a tubular protrusion on an underside of the rotating plate for receiving the control rod, and a second shaft fixed on an opposite side of the rotating plate to the protrusion. The second shaft receives a pinion which is tightly sleeved on the second shaft and which is meshed with the first gear wheel. Thereby, as the first gear transmits the rotation from the output shaft of the motor to the pinion, the pinion is prevented from rotating by the frictional force between itself and the second shaft, so that the rotating plate is caused to turn about the first shaft until the protrusion abuts the restricting edge, whereupon, as the driving force can no longer be transmitted to the rotating plate, it builds up until it overcomes the frictional force of the pinion against the second shaft, and the pinion is made to rotate about the second shaft.

In another aspect of the invention, the gear mechanism further includes a shaft axle rotatably mounted between said output shaft of said front motor and said first shaft, said shaft axle having a bevel gear fixedly mounted thereon coupled to said output shaft, said shaft axle further including a second pinion fixedly mounted thereon above said bevel gear in cooperation with said first gear so as to rotate said first gear; wherein said said rotating plate further includes a third shaft fixed thereon with a third pinion rotatably sleeved thereon engaged with so as to be rotated by said first pinion, said second and third shafts having a cap member attached to top ends thereof to prevent said first and third pinions from sliding off thereat, and wherein said first shaft further includes a second gear mounted above said first gear and engaged with and rotated by said third pinion, while said shaft axle includes a third gear mounted above said second pinion engaged with and rotated by said second gear, so as to dissipate driving force of the front motor when the wheels can no longer be moved.

Thus, as the motor-powered rotation of the wheels must of needs be limited, and the limiting member is the restricting plate, the design of the gear mechanism ensures that no damage is incurred to the motor when the limit is reached.

In another aspect of the invention, the contact means of the controlling mechanism includes four contact members disposed in two facing pairs on the grip member, and the activating finger has two ends, each end located between one of the two pairs of contact members in such a position that when the grip member is rotated, each end respectively of the activating finger contacts one contact member of each pair of contact members, completing a circuit thereat.

In another aspect of the invention, the grip member is shaped in the shape of a steering wheel, to make the action of the toy as realistic as possible, and the weight body is disposed at a central portion of the grip member. In yet another aspect of the invention, the frame includes a direction signalling arrangement comprising a pair of signal lights disposed at an appropriate location on the frame; an electric circuit means adapted to be powered by an electrical source, the electric circuit means being activated to power the lights when the car is turned; and a circuit activating means to activate the circuit means when the car is turned.

The circuit activating means includes two facing contacts disposed close to each other on the underside of the frame; and a contact rod with two ends, one end connected to the circuit means and disposed on the jointed plate transversely, and another end intermediate to said facing contacts and normally out of contact therewith. However, when the jointed plate is turned by said control rod, the contact rod contacts one of the facing contacts and activates a circuit thereat.

When a player desires to play with the car, he grips the grip member, preferably holding it at an upright angle to the ground, and turns on the motors. The rear motor cause the car to move forward. When the player holds the wheel in such a way that the contact means is longitudinally parallel to the ground, the activating finger of the weight body will not contact the contact means. However, when the player turns the grip member so that the contact means is longitudinally oblique to the ground, the activating finger will contact a pair of the contact members and complete a circuit to activate the front motor of which the driving force, in turn will be transmitted to the control rod to turn the toy car.

The presently preferred embodiment of this invention will be described with reference to the following drawings, in which:

DRAWINGS

DETAILED DESCRIPTION OF THE INVENTION

Figure 1:
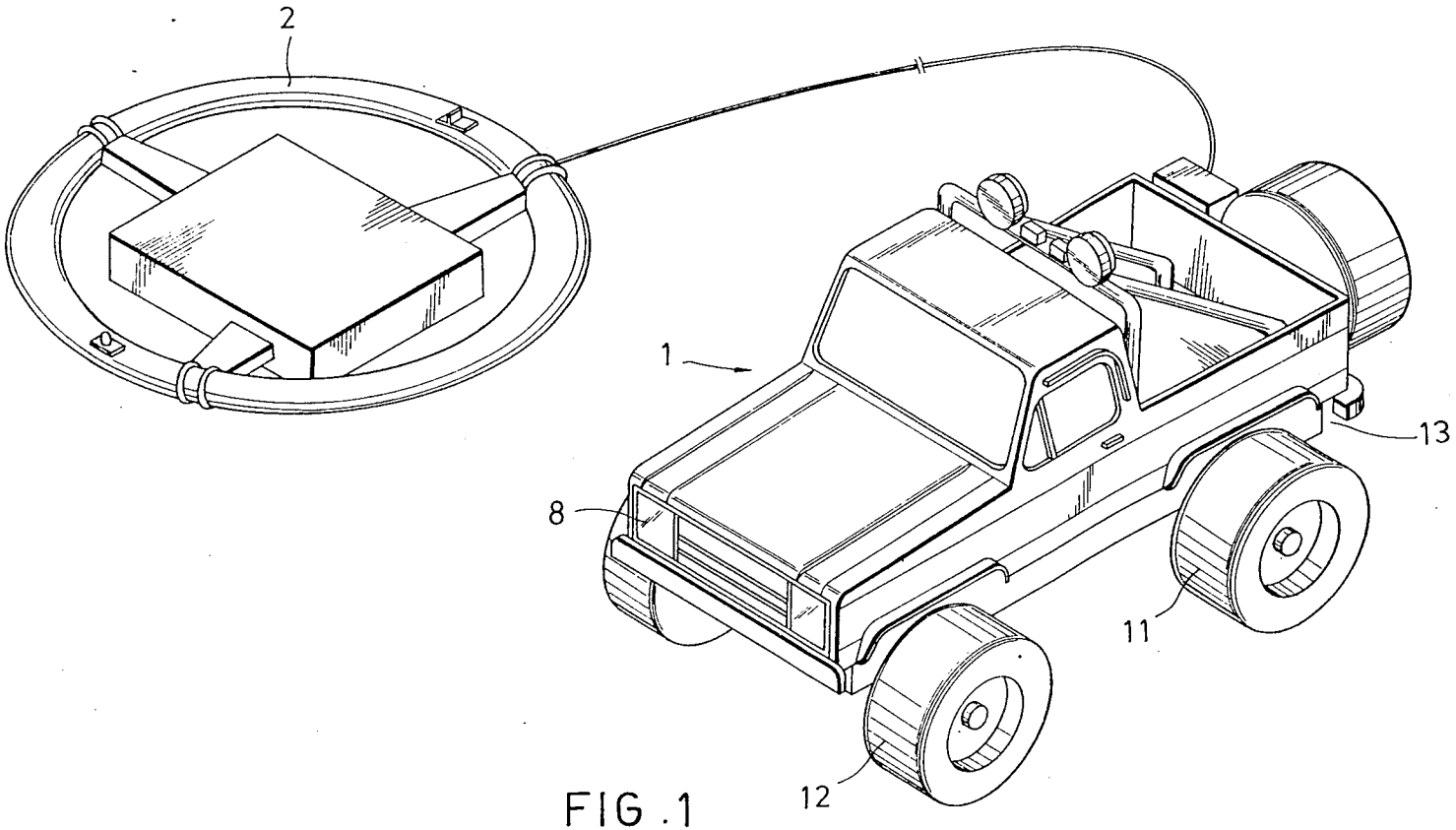
FIG. 1 is a perspective view of a toy car according to this invention.

The following description is not to be taken in a limiting sense, but is made for the purpose of illustrating the invention.

A steerable electric toy car according to the invention has a toy body, including a frame 1, a rear shaft 110; a pair of first wheels 11 on the rear shaft 110; a rear motor 10; a pair of front mounts 120; a pair of second wheels 12 on the front mounts 120; means for controlling the front mounts 120 to move with a respect to a longitudinal axis of the frame 1, including a jointed control plate 30, a control rod 31 engaged with the jointed plate 30, a gear mechanism 39, and a front motor 32. The preferred embodiment of this invention also includes a control mechanism for steering the toy, which comprises a grip member 20; contact members 232,233,232',233', and a weight body 23, the steering of the toy being achieved by a weight biasing and circuit activating arrangement.

Figure 2:
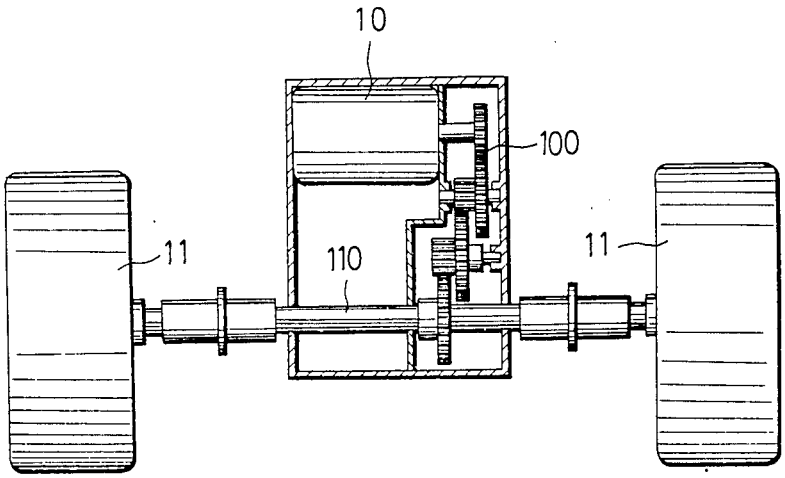
FIG. 2 is a top view of a rear wheel arrangement of the toy car of FIG. 1.

The frame 1 of the toy car is designed in a basically rectangular, vehicular shape. Referring to FIGS. 1 and 2, on a rear underside portion 13 thereof a rear shaft 110 is rotatably mounted transversely, with a pair of first wheels 11 fixedly mounted respectively at opposite ends of the rear shaft 110 adapted through a conventional gearing arrangement 100 to be powered by a rear motor 10 to move backwards and forwards.

On both sides respectively of a front underside portion 3 of the frame 1 are mounted movably a pair of front mounts 120. A pair of second wheels 12 are attached respectively to front mounts 120 and a jointed control plate 30 is attached to the front mounts 120 at two ends of the jointed plate 30 respectively, thus being disposed transversely to the frame 1. Jointed portions 3011 of the jointed plate 30 are located near and attached to the front mounts 120 and are fixed by pivot pins 301. Through the arrangement of the jointed plate 30, the jointed portions 302, the pivots 301, the front mounts 120 and the wheels 12, when the jointed plate 30 is moved with respect to a longitudinal axis of the frame 1, the wheels 12 will turn concurrently.

The jointed plate 30 is controlled to move through by a control rod 31 disposed vertically in the frame perpendicular to the jointed plate 30 and attached to the jointed plate 30 eccentrically on the jointed plate 30. A gear mechanism 39 powered by a front motor 32 controls the control rod 31 to move to a certain extent from side to side in the frame 1, thus causing the jointed plate 30 to move from side to side.

The gear mechanism 39 comprises a gear box in which the front motor 32 is received, a first shaft 34 fixed in the gear box, a first gear 341 rotatably mounted on the first shaft 34 and coupled to an output shaft 321 of the motor 32 so as to be driven by the motor 32. Mounted fixedly on the first shaft 34 below the first gear 341 is a restricting member 38 with a restricting edge 381. A rotating plate 351 is sleeved rotatably on the first shaft 34 between the first gear 341 and the restricting member 38. The rotating plate 351 includes a tubular protrusion 3511 on an underside thereof for receiving the top end of the control rod 31, and a second shaft 355 fixed on an opposite side of the rotating plate 351 from the tubular protrusion 3511. The second shaft 355 receives a first pinion 352 tightly sleeved thereon, which is meshed with the first gear 341.

When the first gear 341 transmits rotation from the output shaft 321 of the motor 32, the first pinion 352 which is meshed with the first gear 341 is prevented from rotating by the frictional force between itself and the second shaft 355. Therefore, the rotating plate 351 is caused to rotate about the first shaft 34 until the protrusion 3511 abuts the restricting edge 381, whereupon, as the driving force can no longer be transmitted to the rotating plate 351, it builds up until it overcomes the frictional force between the first pinion 352 and the second shaft 355, and the first pinion 352 is made to rotate about the second shaft 355 to dissipate the driving force.

As the rotating plate 351 rotates, it moves the control rod 31 to one side, which causes the jointed plate 30 to move to one side and turn the wheels. The restricting member 38 prevents the rotating plate 351 from rotating completely around undesirably. The arrangement of the first pinion 352 and the second shaft 355 protect the front motor 32 from damage as it allows the force which can not be used to turn the wheels 12 to dissipate.

The gear mechanism 39 of the preferred embodiment further includes a shaft axle 33 rotatably mounted between the output shaft 321 of the front motor 32 and the first shaft 34, the shaft axle 33 having a bevel gear 331 fixedly mounted thereon coupled to the output shaft 321. The shaft axle 33 further includes a second pinion 332 fixedly mounted thereon above the bevel gear 331 in cooperation with the first gear 341 so as to rotate the first gear 341; and the rotating plate 351 further includes a third shaft 356 fixed thereon with a third pinion 353 rotatably sleeved thereon engaged with so as to be rotated by the first pinion 352. The second and third shafts 355, 356 have a cap member 354 attached to top ends thereof to prevent the first and third pinions 352,353 from sliding off and the first shaft 34 further includes a second gear 342 mounted above the first gear 341 and engaged with and rotated by the third pinion 353, while the shaft axle 33 includes a third gear 333 mounted above the second pinion 332 engaged with and rotated by the second gear 342. This arrangement provides for dissipation of the driving force of the front motor 32 when the wheels 12 can no longer be moved.

The toy car also includes a realistic directional signal lights arrangement. The arrangement includes a pair of direction signal lights 8 in a front portion of the frame 1, an electric circuit means (not shown) for powering the lights 8, which is powered by an electric source (not shown), and a circuit activating means 304 to activate the lights 8, right and left respectively, when the front wheels 12 are turned.

Figure 3:
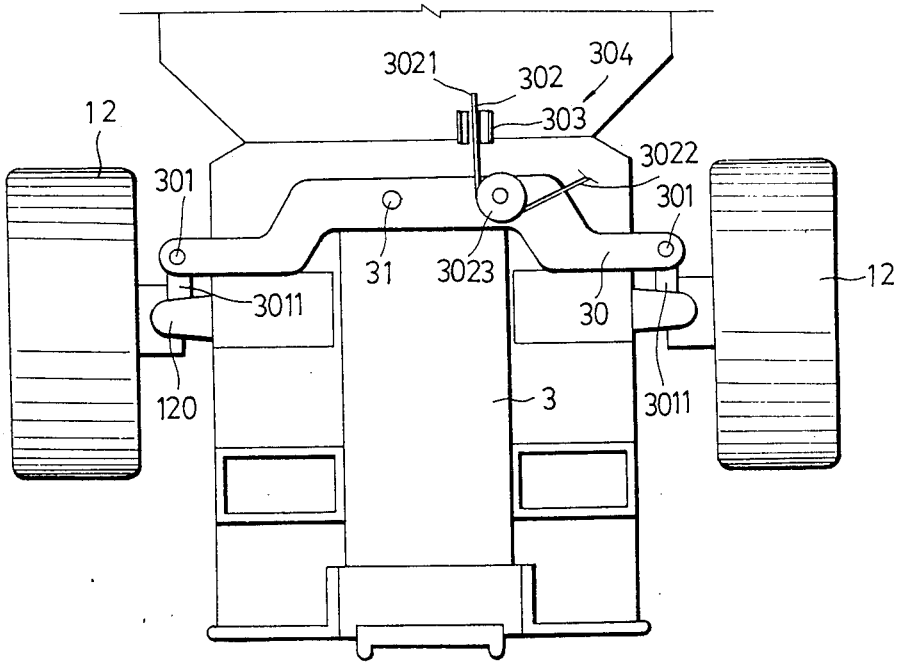
FIG. 3 is a top view of a controlling means of the front wheel arrangement of the toy car of FIG. 1.
Figure 4A:
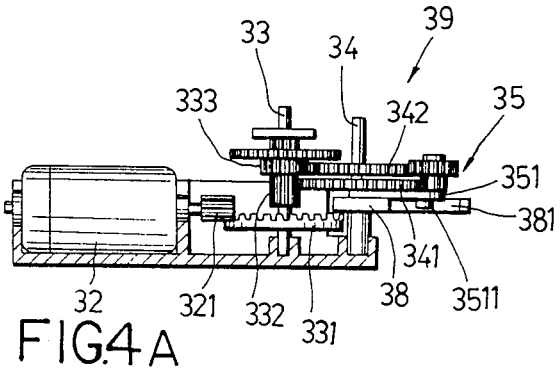
FIG. 4A is an illustrative view of the gear mechanism of the toy car of FIGS. 1, and 4B is an enlarged top view of a portion of the gear mechanism of FIG. 4A.
Figure 4B:
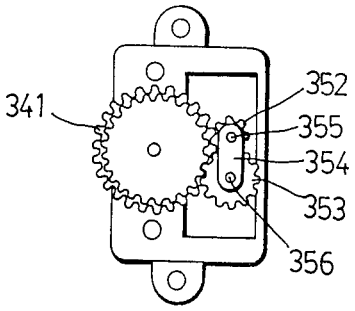

In the preferred embodiment of the invention, referring to FIG. 3, the circuit activating means 304 includes a pair of facing contacts 303 disposed close to each other on the front underside portion 3 of the frame 1, and a contact rod 302 with two ends 3021, 3022, one end 3022 connected to the circuit means and disposed on the frame 1 near the jointed plate 30, and the other end 3021 received intermediate to the facing contacts 303 but normally out of contact therewith. The contact rod 302 of the preferred embodiment is substantially in a V-shape and is attached around a pin 3023 of the jointed plate 30. When the jointed plate 30 is moved by the control rod 31 to move left, the contact rod 302 will be moved left also due to its attachment to the jointed plate 30. At this time it will contact the leftmost facing contact 303, causing a circuit to be completed to light the left directional signal light 8. The right directional signal light 8 is lit in a similar way through the movement right of the jointed plate 30.

Figure 5:
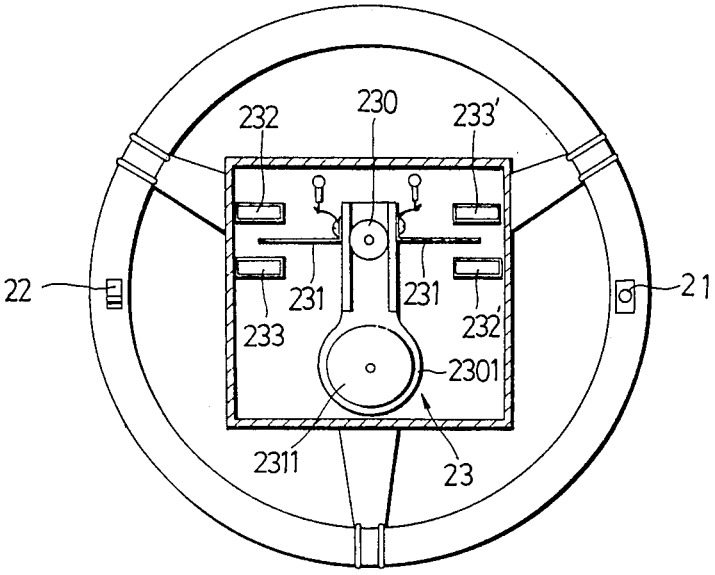
FIG. 5 is an elevation view of the control mechanism of the toy car of FIG. 1.

Referring to FIG. 5, the preferred embodiment of the toy car of this invention is steered with a steering mechanism 2 which includes a grip member 20 in the shape of a steering wheel with a weight body 23 disposed on a central portion of the grip member 20.

The weight body 23 is pivotedly suspended by one end 230 thereof on said grip member 20, with a weight 2311 fixed to another end 2301 of the weight body 23. An activating finger 231 is attached transversely to the weight body 23 near the pivoted end 230 such that two ends of the activating finger 231 project from two sides of the pivoted end 230.

The steering mechanism further includes four contact members 232,233,232',233' disposed in two facing pairs 232,233 and 232',233' on the grip member 20 such that one end of the activating finger 231 rests between but does not abut each pair of contact members 232,233 and 232',233' respectively. The contact members 232,233,232',233' are so disposed that if the uppermost contact member of one pair of contact members 232,232 and 232'233' at one end of the activating finger 231 is contact member 232, the lowermost contact member of the other pair of contact members 232',233' at the other end of the activating finger 231 will be 232'. The circuit means to power the front motor 32 is so arranged that when contact members 232,232' are connected electrically, the front motor 32 is powered to produce rotation in one direction, and when contact members 233,233' are connected, the motor 32 is powered to rotate in another direction.

When the grip member 20 is held in an upright position, the activating finger 231 does not touch the contact members 232,233,232',233' so no circuit is completed. However, when the grip member 20 is rotated, the weight 2311 causes the weight body 23 to remain oriented vertically with respect to the ground, and depending on the direction in which the grip member 20 is rotated, the activating finger 231 will contact an uppermost contact member 232,233,232',233' at one end thereof and a lowermost contact member 232,233,232'233' at another end thereof. The circuit means and circuit activating means described above are connected electrically to the front motor 32 through a cord attaching the grip member 20 and frame 1 of the toy car. Also included on the grip member 20 are two manually operated switches 20 and 21. Switch 20 is a an on-off switch for turning on the power soruce for the circuit activating means, and switch 21 is a dual switch for powering the rear motor 12 to spin backwards and forwards.

While this invention has been described with what is presently considered to be the most preferred embodiment, it is to be understood that the invention is not to be limited to the present embodiment, but is intended to cover all modifications and equivalent arrangements which fall within the scope and spirit of the appended claims.

I claim:

1. A steerable electric toy car comprising:

a toy body, including a frame, a rear shaft rotatably mounted transversely on an underside of a rear portion of said frame;

a pair of first wheels fixedly mounted at opposite ends of said rear shaft, adapted to be driven by a rear motor forwards and backwards, a front shaft, rotatably mounted transversely on the underside of a front portion of said frame;

a pair of second wheels fixedly mounted respectively at opposite ends of said front shaft; and means for controlling said front shaft to move with respect to a longitudinal axis of said frame, including a jointed control plate attached to said front shaft; a control rod engaged with and extending vertically with respect to said jointed plate; a gear mechanism including an output end coupled to said control rod, and a front motor having an output shaft coupled with an input end of said gear mechanism so that rotation from said output shaft can be transmitted to drive said control rod; and a steering mechanism, including a grip member, adapted to be controlled by a player; contact means disposed on said grip member and electrically connected to said front motor of said toy body; and a weight body, pivotedly suspended by one end thereof on said grip member, with a weight disposed at another end of said weight body, and an activating finger disposed on said weight body near the pivoted end of the weight body in such a position that when said grip member is rotated, and said weight causes said weight body by gravity to remain vertically oriented to the ground, thereby the change of relative position of said weight body to said grip members will cause said activating finger to contact said contact means to close a circuit for driving said front motor.

2. A steerable electric toy car as claimed in claim 1, wherein said gear mechanism includes a gear box; a first shaft fixed in said gear box; a first gear rotatably mounted on said first shaft and coupled to said output shaft so as to be driven by said front motor; a restricting member fixed on said first shaft with a restricting edge; a rotating plate rotatably mounted on said first shaft, said rotating plate including a tubular protrusion on an underside of said rotating plate for receiving said control rod; and a second shaft fixed on an opposite side of said rotating plate to said protrusion; and a first pinion tightly sleeved on said second shaft, meshed with said first gear; whereby as the first gear transmits the rotation from the output shaft of the motor to said first pinion, said first pinion is prevented from rotating by the frictional force between itself and said second shaft, so that the rotating plate is caused to turn about the first shaft until the protrusion abuts the restricting edge, whereupon, as the driving force can no longer be transmitted to the rotating plate, it builds up until it overcomes the frictional force of the first pinion against said second shaft, and said first pinion is made to rotate about said second shaft.

3. A steerable electric toy car as claimed in claim 2, wherein said gear mechanism further includes a shaft axle rotatably mounted between said output shaft of said front motor and said first shaft, said shaft axle having a bevel gear fixedly mounted thereon coupled to said output shaft, said shaft axle further including a second pinion fixedly mounted thereon above said bevel gear in cooperation with said first gear so as to rotate said first gear; wherein said said rotating plate further includes a third shaft fixed thereon with a third pinion rotatably sleeved thereon engaged with so as to be rotated by said first pinion, said second and third shafts having a cap member attached to top ends thereof to prevent said first and third pinions from sliding off thereat, and wherein said first shaft further includes a second gear mounted above said first gear and engaged with and rotated by said third pinion, while said shaft axle includes a third gear mounted above said second pinion engaged with a rotated by said second gear, so as to dissipate driving force of the front motor when the wheels can no longer be moved.

4. A steerable electric toy car as claimed in claim 1, wherein said contact means includes four contact members disposed in two facing pairs on the grip member, and wherein said activating finger has two ends, each end located between one of said two pairs of contact members in such a position that when said grip member is rotated, each end respectively of said activating finger contacts one contact member of each said pair of contact members, completing a circuit thereat.

5. A steerable electric toy car as claimed in claim 2, wherein said grip member is shaped in the shape of a steering wheel.

6. A steerable electric toy car as claimed in claim 2, wherein said weight body is disposed at a central portion of said grip member.

7. A steerable electric toy car as claimed in claim 2, wherein said frame includes a direction signalling arrangement comprising a pair of signal lights disposed at an appropriate location on the frame; an electric circuit means adapted to be powered by an electrical source, said electric circuit means being activated to power said lights when said car is turned; and a circuit activating means to activate said circuit means when said car is turned.

8. A steerable electric toy car as claimed in claim 2, where said circuit activating means includes two facing contacts disposed close to each other on the underside of the frame; and a contact rod with two ends, one end connected to said circuit means and disposed on said jointed plate transversely, and another end intermediate to said facing contacts and normally out of contact therewith, wherein when said jointed plate is turned by said control rod, said contact rod contacts one of said facing contacts and activates a circuit thereat.

* * * * *